United States Patent [19]

Koike et al.

[11] 4,404,866

[45] Sep. 20, 1983

[54] REGULATOR HANDLE ASSEMBLY FOR THE OPERATION OF CAR WINDOW GLASS

[75] Inventors: Shyouichi Koike, Tokyo; Toshiharu Iidaka, Funabashi; Akio Ohyama, Kawasaki, all of Japan

[73] Assignees: Nissan Motor Co. Ltd., Yokohama; Kokusan Kinzoku Kogyo Kabushiki Kaisha, Tokyo, both of Japan

[21] Appl. No.: 227,775

[22] Filed: Jan. 23, 1981

[30] Foreign Application Priority Data

Feb. 26, 1980 [JP] Japan ..... 55-22186

[51] Int. Cl.[3] ..... B25G 3/00; G05G 1/00

[52] U.S. Cl. ..... 74/546

[58] Field of Search ..... 74/545, 546, 547

[56] References Cited

U.S. PATENT DOCUMENTS 3,198,032 8/1965 Pollak ..... 74/545
3,475,986 11/1969 Schamel ..... 74/547
3,477,309 11/1969 Sprecher ..... 74/547
4,052,768 10/1977 Yamazaki et al. ..... 74/545 X

FOREIGN PATENT DOCUMENTS 1555178 12/1969 Fed. Rep. of Germany ..... 74/545
309659 9/1955 Switzerland ..... 74/545

*Primary Examiner*—Ernest R. Purser
*Attorney, Agent, or Firm*—Fleit, Jacobson, Cohn & Price

[57] ABSTRACT

A regulator handle assembly for the positional control of a car window glass includes a handle lever combined with a spring-loaded manual knob arranged slidable and rotatable on a hollow sleeve made at the free end of the handle lever integral therewith. This knob is slidable relative to the hollow sleeve and in the outward direction when manipulating the handle so as to enlarge the overall height thereof against action of a coil spring mounted within the knob. When the manual operating pressure is released, the knob is automatically returned to its height-shortened normal position under the influence of the coil spring.

6 Claims, 3 Drawing Figures

REGULATOR HANDLE ASSEMBLY FOR THE OPERATION OF CAR WINDOW GLASS

BACKGROUND OF THE INVENTION

This invention relates to improvements in and relating to regulator handle for opening and closing operation of car window glass through its sliding and/or turning movement.

A substantial drawback inherent in the conventional regulator handle of the above kind resides in its too much large height relative to the related door or the related part of the car chassis, causing the driver or passenger(s) much accidental personal troubles, as is well known. A main drawback is to give personal damage to the driver or passenger, caused by shocking physical contact with the projecting part of the handle, such as its manipulating knob, which may appear in an accidental car collision or the like.

It is, therefore, a sincere desire among car designers and even car utilizers to reduce as much the regulator handle overall height as possible, and indeed, without sacrificing handling convenience of the handle.

SUMMARY OF THE INVENTION

It is a main object of the present invention to provide an improved regulator handle assembly which has a smaller size of height when it is possible in non-service position, yet having an increased height in its service and operating position for providing a handling easiness and convenience.

A further object is to provide a regulator handle which is capable of manufacturing and assembling its parts in a more easy and convenient way.

For fulfillment of the above and further objects of the invention, it is now proposed to provide an improved car glass regulator assembly comprising a lever handle having an enlarged root end and a small opposite end, the latter having a laterally extending sleeve made integral therewith. This sleeve is formed at its root portion with an inwardly and radially extending ring projection which is solid with main cylindrical portion of the sleeve through a rootwardly tapered intermediate portion of same. On the other hand, the sleeve is formed on its outer surface and at the root portion thereof with a radially and outwardly extending shoulder. The assembly further comprises a hollow knob having a substantially straight inside surface for axially slidably receiving a flanged intermediate member which is rigidly connected with said sleeve for performing unitary motion therewith. The knob is formed at its root end with a radially and inwardly extending ring portion having at its inside periphery a substantially thickened ring portion for performing easy and smooth sliding motion in contact with the outer cylindrical surface. At its non-service position of the knob, the ring portion rests upon the said shoulder formed on the root portion of said sleeve. As most important feature of the invention, the core portion of said intermediate member slid into the hollow cylindrical inside space of the sleeve is formed with a plurality of, say 2–4 resilient root wings, each having an outer configuration so as to make tight engagement with the radially inwardly extending ring projection formed on the root portion and at the inside of said sleeve for acting as a kind of hook so as to execute unitary, but reseparable connection with the handle lever.

A cover is assembled retouchably at the upper end of the knob for providing a smart appearance and dust proofness as well as easy handling performance thereof. There is a coil spring inserted under certain compression between the knob and the intermediate member, so as to maintain the knob at its normal lower position.

All these above mentioned parts; handle lever; sleeve; intermediate member together with resilient root hooks and knob with cover are made preferably of hard plastics, and with exception of the coil spring.

When it should be manually operated, the knob is pulled up to its operating position for increasing the overall height of the assembly and thus providing an easy manipulation.

This and further objects, features and advantages of the invention will become more apparent when reading the following detailed description of a preferred embodiment of the invention to be set forth with reference to the accompanying drawings, in which:

DETAILED DESCRIPTION OF THE INVENTION

Figure 1:
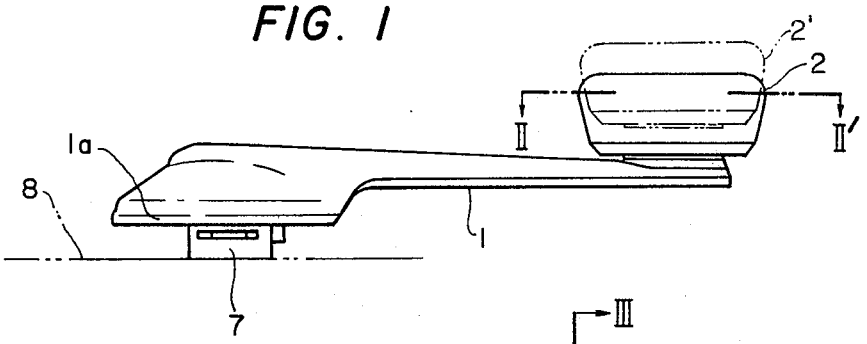
FIG. 1 is a side elevation of the handle assembly as constructed in accordance with the novel and inventive technical idea.

In the drawings, numeral 1 represents generally a handle lever, having an enlarged root portion 1*a*. The handle lever 1 is mounted rotatably at this enlarged end 1*a* through a pin-and-bearing unit 7, as conventionally on a part of car door or chassis 8 which is shown only in an imaginary manner by means of a single chain-dotted line.

Figure 3:
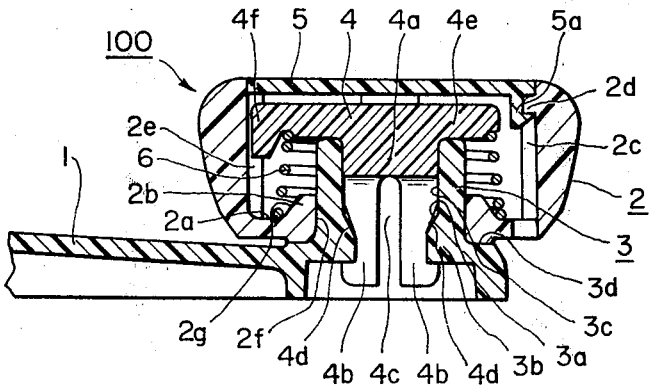
FIG. 3 is a sectional view of a substantial part of the regulator handle assembly, the section being taken along a section line III—III' shown in FIG. 2.

At the small free end of the handle lever, a laterally projecting sleeve 3 is formed integrally with the lever, as specifically shown in FIG. 3. At the root end of the integral sleeve 3, is formed integrally an inwardly projecting, cylindrical ring projection 3*b*. There is an inwardly and downwardly tapered shoulder 3*a* between the ring projection 3*b* and the remaining thinner and again cylindrical main portion at 3*c* of the lateral sleeve 3 for unitary and substantially smooth connection of the both parts 3*b* and 3*c* at the inside wall surface of the sleeve, and so as to provide a female member of the hook to be mentioned hereinbelow. Further, a supporting outer ring surface 3*d* is formed in a laterally and outwardly extending mode relative to the sleeve 3 and at the root portion thereof, so as to provide a kind of supporting shoulder.

Numeral 2 denotes main portion of a manual knob, generally shown at 100, said main portion having at its lower end a thickened mass ring 2*b* and a thinner connection ring portion 2*a* made integral with the main portion. The first ring 2*b* is formed at its inside with a vertically extending ring surface 2*f* which is slidably engaged with the outer cylindrical surface of sleeve 3, as will be more fully described hereinafter.

Figure 2:
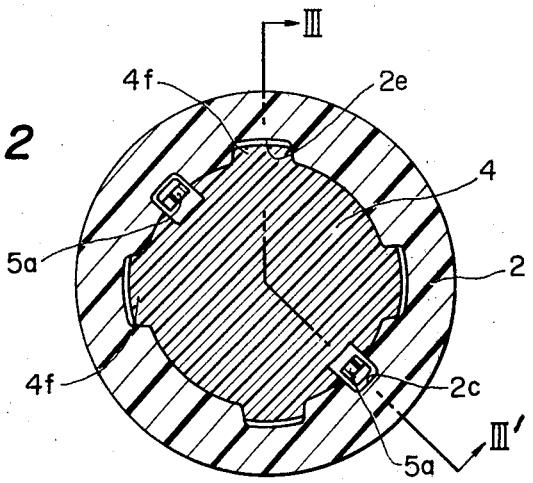
FIG. 2 is a cross-section of a manual knob and several cooperating parts therewith, the section being taken along a section line II—II' shown in FIG. 1.

A pair of vertically extending and diametrically opposed grooves 2*c* are formed in the inside surface of the main portion 2 of said knob. In addition thereto and separated therefrom, a plurality of, herein four in number, slightly broader vertical grooves 2e are provided at equal circumferential distances, as most clearly shown in FIG. 2. An inwardly projecting stop 2d is formed on the bottom of each of said first grooves 2c at a place selected near the upper end of the groove.

Numeral 4 represents an intermediate member or cap piece, having a central core or plug portion 4a which is snugly, yet rotatably received in and by the upper part of the bore defined in and by the cylindrical portion 3c. The plug portion is made integral with a flange portion 4e, so as to provide in combination a kind of flanged plug, having a pair of downwardly directed springy legs 4b, each of which is formed with a recess 4d having a configuration for snugly engaging the tapered ring projection 3b;3b on the sleeve 3. Thus, the recess 4d may act as a coooperating male part of the key connection, to be set forth. If necessary, the number of springy legs 4b may be increased to three, four or more. By the provision of only one axial cut 4c, these legs are two in number. When a cross cut as at 4c is employed, these springy legs may be increased to four in number. The leg arrangement shown in FIG. 3 corresponds to this last mentioned case.

The projection 4f projects outwardly from the flange portion 4e and is received in the groove 2e of the knob 2, so that the knob 2 is movable or slidable relative to the intermediate member 4 in the up-down direction in FIG. 3 but rotates together with the intermediate member 4 in operation.

Cover disc 5 is formed on its lower surface integrally with a pair of resilient and radially opposite hooks 5a. When the cover disc is inserted from the upper side into the upper opening of the cylindrical main body of knob 2, it is firmly held in position by the engagement of these hooks 5a with the mating ring projection 2d.

Finally, numeral 6 represents a return coil spring inserted between the intermediate plug 4 and the root ring portion 2a;2b, thus making no contact with sleeve 3. Since the knob 2 and intermediate plug 4 are rotatable in unison with each other when subject to manual rotational effort for elevating or lowering the car window glass, not shown, the coil spring will also be rotated together with the knob 2 and the intermediate plug 4, and thus, no excess stresses and distorsion will occur due to the torsion force which otherwise would be applied to spring 6 and a longer durable life of the spring can be assured.

In assemblying, the knob proper 2 is inserted from the upper side in FIG. 3, until the lower surface of thickened and innermost ring projection 2b abuts on the outer ring bearing surface 3d and then, coil spring is inserted again from the upper side in position. In this case, the outer inclined cone ring surface 2g of said projection 2b will effectively serve for stabilized positioning of the coil spring 6.

Then, plug member 4 is inserted axially from the upper side so as to engage its core portion 4a into the upper part of the cylindrical bore by application of a slightly strong manual pressure. At the last stage of such axial push of the intermediate plug, all the resilient legs 4b of the plug are brought into hooking engagement with the tapered ring projection 3a; 3b of sleeve 3, while the coil spring is correspondingly compressed. Finally, the cover disc 5 is packed under pressure from the upper side in position, until the hook projections 5a are brought into packed engagement with inner ring projections 2d of knob proper 2.

Therefore, only four steps are required for the assembly of four constituent parts onto the sleeve 3 of handle lever 1.

Disassembly job can be executed in the reverse order.

In the use of the regulator handle assembly, the operator can pull the knob 100 upwards in FIG. 3 against the action of coil spring 6 until the upper surface of thickened ring portion 2b abuts precisely or substantially on the main portion of flange 4e of the plug 4, as shown by the phantom line in FIG. 1, so as to increase the overall height of knob 100 and easy grip and manipulation thereof. Rotational manipulation of the handle lever 1 can be conventionally performed through manual grip of the knob assembly 100 in the usual manner.

Since regulation of the car window glass position by lowering or elevating thereof is highly conventional, the related gearing is not shown and described herein.

However, as an example, rotational regulaing movement of handle lever is directly transmitted to its pivot shaft which cooperates through a pinion or the like, not shown, with a pinion or the like rotatably mounted on the glass-holding frame, and so on.

Upon completion of a glass window position regulation, the operator recedes his hand from the knob which is then freed from the manual pressure, and returned to its normal off-service position shown in FIG. 3.

What is claimed is:

1. Regulator handle assembly for operating a window glass of a vehicle, comprising:

a handle lever associated with said window glass, a cylindrical sleeve formed at the free end of said handle lever, said sleeve being substantially perpendicular to said handle lever and having at its lower portion a projection extending inwardly from an inner surface thereof, a plug member rotatably received in said cylinder, said plug member having an extended leg which hooks on said projection and having a projection extending outwardly over said sleeve, a hollow knob being rotatable relative to said sleeve, said hollow knob having at its lower portion a projection extending inwardly and at its inner surface an axially extending recess which axially slidably receives said projection of said plug member, and a spring disposed between said projections of said plug member and said hollow knob, said plug member, said hollow knob, and said spring being rotatable as a unit with respect to said sleeve, whereby said hollow knob is normally in a retracted position and can be pulled out to be manipulated.

2. Regulator handle assembly for operating a window glass of a vehicle, comprising:

a handle lever associated with said window glass, a cylindrical sleeve formed at the free end of said handle lever, said sleeve being substantially perpendicular to said handle lever, a plug member rotatably received in said sleeve, means for connecting said sleeve and said plug member so that said plug member is rotatable with respect to said sleeve and so that axial movement of said plug member with respect to said sleeve is opposed by said means for connecting, a hollow knob surrounding said sleeve and said plug member, means for axially slidably but unrotatably connecting said plug member and said hollow knob, a spring for urging said hollow knob towards an axially retracted position, and means for supporting said spring between said plug member and said hollow knob so that said spring, said plug member, and said hollow knob are rotatable as a unit with respect to said sleeve, whereby said hollow knob is normally in the retracted position and can be pulled out to be manipulated.

3. The regulator handle assembly of claim 1 or 2, wherein a cover disc is attached to main portion of said knob in a snap hook engagement.

4. The regulator handle assembly of claim 1 or 2, wherein said spring is held in position without contact with said sleeve.

5. The regulator handle assembly of claim 1 or 2, wherein a plurality of projections extend outwardly from a flange portion of said plug member and are axially slidably received in corresponding grooves formed in an interior surface of the knob.

6. Regulator handle assembly for operating the window glass of a vehicle comprising:

a handle lever associated with said window glass, a cylindrical sleeve formed at the free end of said handle lever, said sleeve being substantially perpendicular to said handle lever and having at its lower portion a projection extending inwardly from an inner surface thereof, a plug member rotatably received in said cylinder, said plug member having an extended leg which hooks on said projection and having a projection extending outwardly over said sleeve, a hollow knob rotatable relative to said sleeve, said hollow knob having at its lower portion a projection extending inwardly to contact an exterior surface of said cylindrical sleeve so that the cylindrical sleeve guides axial movement of said hollow knob and at its inner surface an axially extending recess which axially slidably receives said projection of said plug member, and a spring disposed between said projections of said plug member and said hollow knob for urging said hollow knob into a retracted position, said plug member, said hollow knob, and said spring being rotatable as a unit with respect to said sleeve during rotation of said hollow knob.

* * * * *